United States Patent [19]

Matsukage

[11] Patent Number: 4,769,799

[45] Date of Patent: Sep. 6, 1988

[54] INLAYING WATCH

[75] Inventor: Hiroki Matsukage, Tokyo, Japan

[73] Assignee: J. Osawa & Co., Ltd., Tokyo, Japan

[21] Appl. No.: 50,030

[22] Filed: May 15, 1987

[30] Foreign Application Priority Data

May 27, 1986 [JP] Japan ..... 61-80063

[51] Int. Cl.[4] ..... G04B 37/00; G04B 47/00

[52] U.S. Cl. ..... 368/278; 368/10; 224/903; 2/1

[58] Field of Search ..... 368/88, 10, 276, 278, 368/285; 224/164, 158, 191, 903; 248/114–116; 2/1, 16, 170

[56] References Cited

U.S. PATENT DOCUMENTS

| | | | |
|---|---|---|---|
| 499,891 | 6/1893 | Schlesicky | 224/164 |
| 1,416,653 | 5/1922 | Lenneberg | 224/903 |
| 4,682,310 | 7/1987 | Lund et al. | 368/278 |

FOREIGN PATENT DOCUMENTS

| | | | |
|---|---|---|---|
| 763655 | 5/1924 | France | 368/278 |
| 59-986 | 1/1984 | Japan . | |
| 59-190279 | 12/1984 | Japan . | |
| 60-61077 | 4/1985 | Japan . | |
| 137354 | 12/1929 | Switzerland | 368/278 |

*Primary Examiner*—Vit W. Miska

*Attorney, Agent, or Firm*—Cushman, Darby & Cushman

[57] ABSTRACT

An inlaying watch comprising a holder ring mounted in a hole bored through a personal belonging, a watch body having a flange and a groove formed entirely in a portion of a circumferential surface of the watch body adjacent the flange, and a mount ring having spaced resilient projections with claws formed in an inner diameter portion thereof, said watch body and mount ring being removably fitted together in the position of said holder ring from opposed directions so as to allow the claws to engage into said groove to thereby porvide a unitary structure.

4 Claims, 3 Drawing Sheets

INLAYING WATCH

BACKGROUND OF THE INVENTION

The present invention relates to an inlaying watch, and more particularly to an inlaying watch which one oan oarry by removably attaching to personal belongings which he directly or indirectly wears or brings.

Requirement for controlling of time in lives is increased in this highly civilized society, and thus existence of timepieces as mean for controlling of time is very important for rationalization in living environment. In this respect, there exist a variety of timepieces within and around buildings, and therefore in such a space, it would be easy to correctly check time wherever one moves. In an area far from the buildings, however, it would be the best method to carry or bring a watch in order to know time correctly. For such reasons, there hitherto have been some kinds of watches which one can directly or indirectly wears or brings. For instance, there are wrist watches, leg watches (mainly for women), pendant watches (necklace type watches), etc. as those which one directly wears on his body for carrying, and there are pocket watches, travel watches (foldable travel watches also usable as alarm watches), etc. as those which one indirectly carries or brings.

Such conventional watches which one directly or indirectly brings, however, involve the following problems:

(1) They are all present as independent existents, and therefore it is difficult to move them from their inherent positions to others for diversion to allow watches of the type carried by being worn on a human body to be indirectly carried, or watches of the indirectly brought type to be directly worn on a human body. For instance, even if one tries to divert a wrist watch by moving to other positions than a wrist, it is not satisfactory as the wrist band would be an obstruction therefor.

(2) The above fact further results in that the conventional watches have the problems that one must bring many types of watches which meet all carrying requirements and this is not economical, and further one must use different watchs for respective change in carrying requirements and this requires elongated time upon exchange of a watch to meet the changed carrying requirement, so that rationalization in livinG environment by controlling of time could not be satisfied.

SUMMARY OF THE INVENTION

The present invention intends to solve the above-mentioned problems, and to this end the watch of the present invention is made removable by itself from personal belongings, and therefore change in the watch either to the directly carried type or indirectly carried type can be readily attained merely by exchange of the associated personal belongings, thereby providing such an advantage as to permit rationalization in living environment by controlling of time to be satisfied with ease.

The inlaying watch of the present invention is characterized by a holder ring mounted in a hole bored through a personal belonging; a watch body having a flange and a groove formed entirely in a portion of a circumferential surface of the watch body adjacent the flange; and a mount ring having spaced resilient projections with claws formed in an inner diameter portion thereof: said watch body and mount ring being removably fitted together in the position of said holder ring from opposed directions so as to cause the claws to engage into said groove to thereby provide a unitary structure.

With such a structure, when the inlaying watch is to be mounted to a personal belonging such as a wrist band for use as a wrist watch, the inlaying watch is separated into the watch body and mount ring. The watch body is then inserted from below in the holder ring mounted in the hole of the wrist band with the flange abutting against the holder ring, and thereafter the mount ring is applied by fitting the projections from above into a clearance between the inner diameter portion of the holder ring and the outer diameter portion of the watch body while inserting the claws thereinto, so that the base of the projections sealingly fills up the inlet opening portion of the clearance while the claws formed at the tips of the projections are brought into engagement into the groove of the watch body, thereby providing a wrist watch with the wrist band of a unitary structure formed of the watch body and the mount ring.

When the inlaying watch is to be diverted from the wrist watch to others, the mount ring is separated in a direction opposite from the side where the flange of the watch body is located while the watch body is supported with being pressed, so that the claws that have engaged into the groove of the watch body are withdrawn therefrom due to resilient pliability of the projections to thereby allow the watch body and mount ring to be separated from eaoh other with ease. Thus, it will be understood that the inlaying watch can be readily diverted to the other types of watchs by fitting the watch body and mount ring on and assembling them with the holder ring of the other kinds of personal belongings in the same manner as above-mentioned.

BRIEF DESCRIPTION OF THE DRAWINGS

Other features and advantages of the present invention will become apparent from the following description of embodiments with reference to the aooompanying drawings wherein.

DETAILED DESCRIPTION OF THE PREFERRED EMBODIMENTS

Figure 1:
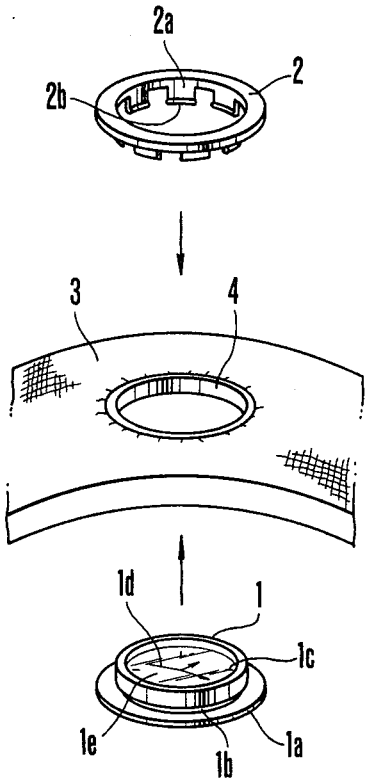
FIG. 1 is an exploded perspective view showing the directions of fitting of an inlaying watch according to a first embodiment of the present invention.
Figure 2:
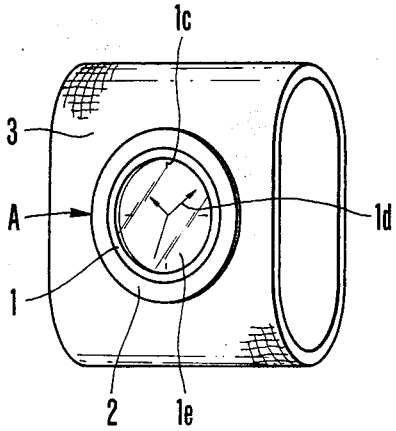
FIG. 2 is a perspective view of the watch upon completion of assembling.
Figure 3:
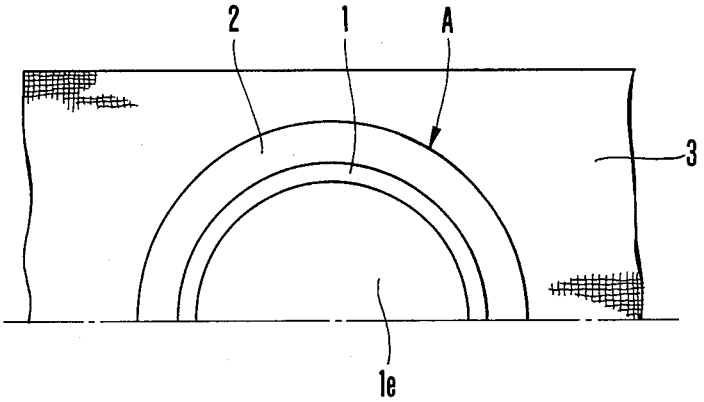
FIG. 3 is a plan view of the main portion of same.

Referring to FIGS. 1 through 4, there is shown a first embodiment of the present invention, in which an inlaying watch A is made as being directly worn on a human body through personal belongings. The inlaying watch essentially comprises a watch body 1 having a watch mechanism, etc. contained therein, a mount ring 2 attached to and assembled with the watch body 1, and a holder ring 4 on which the inlaying watch A comprising the watch body 1 and mount ring 2 is fitted.

In the first embodiment, the personal belonging which is a parent body of a element on which the inlaying watch A is mounted comprises a wrist band 3 formed of strips of elastic textile material knitted into an annular element of a size suitable for an arm of a human body. The wrist band 3 has a hole of a predetermined diameter bored therethrough in a portion of the annular surface, and the holder ring 4 of a U-shape in cross section is mounted in the position of the hole of the wrist band 3 with the U-shape clamping an edge portion of the hole between the free ends of the legs thereof.

Figure 4:
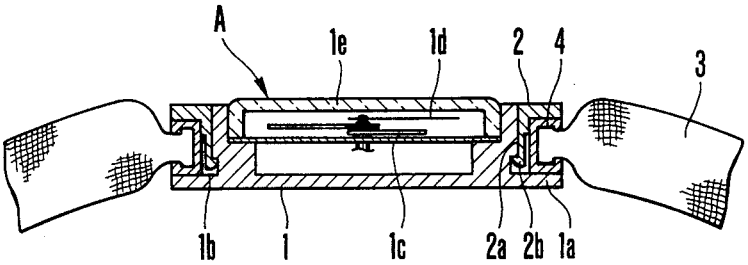
FIG. 4 is a partly sectional view of the portion of the watch shown in FIG. 3.

As shown in FIGS. 1 and 4, the watch body 1 having an annular body with a bottom comprises a flange 1*a* of a predetermined diameter formed in a bottom side periphery of the annular body in the same plane as the bottom of the annular body, and a groove 1*b* formed entirely in a circumferentia1 surface of the annular body adjacent the flange 1*a*. Like the known watches, there are arranged a face 1*c* and hands 1*d* covered and protected by a transparent disk 1*e* on the side of a front surface of the watch body 1, the watch mechanism not shown being contained in the watch body on the side of a rear surface of the face 1*c* so as to allow movement of each of the hands 1*d*.

The mount ring 2 assembled with the watch body 1 is formed as follows. As shown in FIGS. 1 through 4, the mount ring 2 has circumferentially spaced strip-like projections 2*a* formed in an inner diameter portion of a ring body of the mount ring 2, the ring body having the substantially same outer diameter as the holder ring 4 and an inner diameter suitable to fit on the outer circumferential surface of the annular body, each projection having a length substantially extending to the vicinity of the flange 1*a* of the watch body 1 and providing a predetermined resilience by having the rest of the upper base of the projection formed into a thin web. The tip of each projection 2*a* on the inner side is formed with a claw 2*b* which engages into the groove 1*b* of the watch body 1.

The above-mentioned watch body 1 and mount ring 2 are assembled by fitting the inner diameter portion of the mount ring 2 onto the outer circumferential surface of the watch body 1 from above, the inner circumferential surface of each projection 2*a* being loosely fitted on the outer circumferential surface of the watch body 1 with an appropriate clearance and the claw 2*b* of each projection 2*a* being engaged into the associated portion of the groove 1*b* with a resilient support of the projection, thereby providing a set of removable inlaying watch A.

As shown in FIGS. 1 and 4 in explosion into the watch body 1 and mount ring 2, the inlaying watch A is fabricated by fitting the watch body 1 and mount ring 2 together from opposed directions with respect to the holder ring 4 of the wrist band 3. More specifically, the watch body 1 is fitted with the the flange 1*a* abutting against the lower surface of the holder ring 4 while the mount ring 2 is removably fitted on the outer annular circumferential surface of the watch body 1 with the rear surface of the mount ring abutting against the upper surface of the ho1der ring 4, which leads to resilient engagement of each claw 2*b* of the mount ring 2 into the groove 1*b* of the watch body 1, thereby providing the inlaying watch with the wrist band 3 of a unitary structure, with the holder ring 4 being clamped between the flange 1*a* of the watch body 1 and the ring surface of the mount ring 2.

When the inlaying watch A of the above-mentioned first embodiment is to be carried as a directly worn wrist watch, the watch A is firstly separated into the watch body 1 and the mount ring 2 as shown in FIG. 1. The watch body 1 is then, as shown in FIG. 4, inserted from below in the holder ring 4 mounted in the hole of the wrist band 3, with the upper surface of the flange 1*a* being brought to abut against the lower surface of the holder ring 4.

Next, the mount ring 2 is incorporated by fitting the projections 2*a* from above into the clearance between the inner diameter portion of the holder ring 4 and the outer diameter portion of the watch body 1 while inserting the claws 2*b* thereinto. This results in the structure that the upper base portion of the projections 2*a* fills up the upper opening portion of the clearance while the claws 2*b* provided at the tips of the projections 2*a* engage into the groove 1*b* of the watch body 1 with resilient support of the projections 2*a*, thereby enabling the watch body 1 and the mount ring 2 to be assembled into a removable wrist watch of a unitary structure with the wrist band through the holder ring 4 of the wrist band 3. See FIG. 2.

The inlaying watch A assembled into the wrist watch in this way can be worn on a wrist of an arm not shown with elastic force of the fabric material of the wrist band, and this permits the inlaying watch A to be prevented from shaking as the wrist band 3 tigh11y contacts the arm portion when it is used as a wrist watch during sports such as jogging, tennis, etc. Further, if a user sweats when doing sport, the fabric-made wrist band 3 is effective to absorb the sweat, and this avoid such problem as otherwise to appear a sweat rash on the skin of the arm portion where the watch A is directly worn.

When the above-mentioned inlaying watch A is diverted from the wrist watch to others, the watch body 1 is at first supported with a finger of a user set on the bottom of the watch body 1 as a support while being pressed from above and simultaneously the mount ring 2 is pushed up in a direction opposite from the side where the flange 1*a* of the watch body 1 is located so as to separate the ring 2 from the watch body 1, so that the claws 2*b* that have engaged into the groove 1*b* of the watch body 1 are withdrawn therefrom due to resilient pliability of the projections 2*a* to thereby allow the watch body 1 and mount ring 2 to be separated from each other with ease, while allowing both the elements 1, 2 to be separated from the wrist band 3. Thus, it will be understood that the inlaying watch A can be readily diverted to the other type of watchs by fitting the watch body 1 and mount ring 2 on and assembling them with a holder ring of other kinds of personal belongings in the same manner as above-mentioned.

Figure 5:
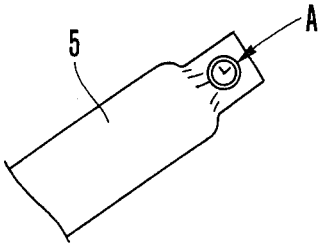
FIG. 5 is a fragmentary view of a training shirt with an inlaying watch mounted thereon according to a second embodiment of the present invention.
Figure 6:
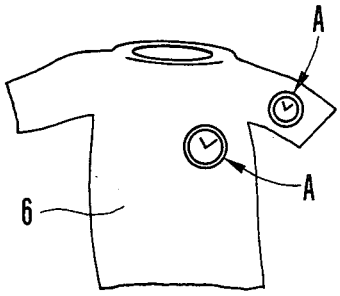
FIG. 6 is an elevational view of a T-shirt with the inlaying watch of the second embodiment mounted thereon.

A seoond embodiment of the present invention now will be explained with reference to FIGS. 5 and 6. In the second embodiment, the inlaying watch A explained in the first embodiment is incorporated suoh that in FIG. 5 a hole is bored, as in the first embodiment, in a portion of a sleeve end portion of a training shirt 5 as a personal belonging and the above-mentioned holder ring 4 is mounted at a position of the hole, and thereafter the inlaying watch A is assembled in the holder ring 4 not shown. In FIG. 6, the inlaying watch A is incorporated in a portion of a sleeve or breast of a T-shirt as a personal belonging in the same manner as in FIG. 5.

It will be noted that in the second embodiment, the inlaying watch A is not directly worn on part of a human body as in the firstly-mentioned wrist watch, but is fitted on a portion of clothes worn on a human body. Thus, there is provided not only a novel utility as an alternative of a wrist watch or pocket watch. but also an advantage to offer a novel fashion.

Figure 7:
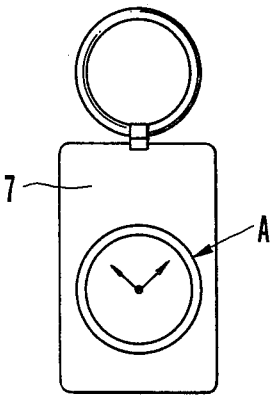
FIG. 7 is a perspective view of a key holder with an inlaying watch mounted according to a third embodiment of the present invention.
Figure 8:
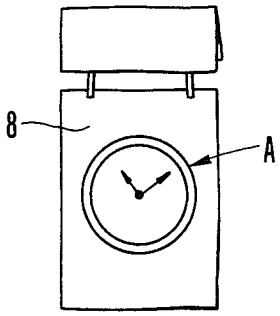
FIG. 8 is a perspective view of a nurse watch with the inlaying watch of the third embodiment mounted thereof.

A third embodiment of the preoenl invention will be explained with reference to FIGS. 7 and 8. In the third embodiment, the above-mentioned inlaying watch A is used such that in FIG. 7 a hole is bored, as in the previous embodiments, in a portion of a support of a key holder 7 as a personal belonging and the above-mentioned holder ring 4 is mounted at a position of the hole, and thereafter the inlaying watch A is assembled in the holder ring 4 not shown. In FIG. 6, the inlaying watch A is removably incorporated in a portion of a watch support of a nurse watch 8 as a personal belonging in the same manner as in FIG. 5 instead of the conventional fixed watch.

It will be noted that in the third embodiment, the inlaying watch A is not directly worn on part of a human body or fitted on a portion of clothes as in the writs watch of the first embodiment or the fashion watch of the second embodiment, but is fitted on a portion of a key holder 7 or a nurse watch 8 suspended outside of clothes worn instead of the conventional watch. Thus, there is provided the same effect as the wrist watch or pocket watch to unique personal belongings. as well as a utility which the watch essentially has.

Further, although not shown, the inlaying watch A alternately may be applied to a grove by mounting the above-mentioned holder ring 4 to a portion of the back or wrist of the grove and incorporating the inlaying watch A in the holder ring 4 not shown. In this alternative, since the the inlaying watch A is located at the position of the back or wrist of the grove, it is not necessary in the oase of ski groves, for example, to conduct a troublesome action to roll up the wrist portion of a grove to see behind a wrist watch worn on an arm as conventionally conducted, and the inlaying.watch A in the portion of the back or wrist of the grove advantageously allows a user to oheok time readily and quickly.

As will be apparent from the foregoing, the inlaying watch of the present invention is characterized by a holder ring mounted in a hole bored through a personal belonging; a watch body having a flange and a groove formed entirely 1n a portion of a circumferential surface of the watch body adjacent the flange; and a mount ring having spaced resilient projections with claws formed in an inner diameter portion thereof; said watch body and mount ring being removably fitted together in the position of said holder ring from opposed directions so as to cause the claws to engage into said groove to thereby provide a unitary structure. Thus, the watch of the present invention is made removable by itself from personal belongings, and therefore change in the watch either to the directly carried type or indirectly carried type can be readily attained merely by exchange of the associated personal belongings and this enables a variety of carried systems of the inlaying watch to be realized, thereby providing such an advantage as to permit rationalization in living environment by controlling of time to be satisfied with ease.

What is claimed is:

1. An inlaying watch comprising:

a holder ring mounted in a hole provided through a personal belonging;

a watch body having a flange and a groove formed entirely in a portion of a circumferential surface of the watch body adjacent the flange;

a mount ring having spaced resilient projections with claws formed on an inner diameter portion thereof;

said watch body and mount ring being removably fitted together in the position of said holder ring from opposed directions so the claws engage into said groove to thereby provide a unitary structure;

said projections being formed at an inner diameter portion of a ring body of the mount ring, the ring body having the substantially same outer diameter as the holder ring and an inner diameter suitable to fit on the circumferential surface of the watch body, each projection having a length substantially extending near to the vicinity of the flange of the watch body and providing a predetermined resilience by having the rest of an upper base thereof formed into a thin web.

2. An inlaid watch, comprising:

a sheet of material having a first surface and, opposite to said first surface, a second surface;

means providing an opening through said sheet between and opening through said first and second surfaces, said opening-providing means including a radially inwardly-opening, perimetrically-extending edge;

a holder ring mounted in said opening and secured to said sheet of material as a perimetrically extending lining for said opening, said holder ring having an axially extending, perimetrically-extending radially inner edge surface and two axially opposite ends located adjacent respective of said first and second surfaces of said sheet of material;

a watch having a case including a rear wall, an axially and perimetrically extending side wall having a radially outer surface, a transparent disk covering a face and time-indicator means of said watch and mounted to said case;

said outer surface of said side wall of said watch case being smaller in breadth than said inner edge surface of said holder ring;

means defining a radially outwardly-opening groove in said outer surface of said side wall axially adjacent said rear wall of said case;

means defining a radially outwardly-projecting flange on said side wall of said case radially adjacent said rear wall of said case;

said watch being telescopically inserted into said opening from said second surface so that said flange axially confronts and abuts one of said ends of said holder ring adjacent said second surface of said sheet of material, said radially outwardly-opening groove-defining means lies disposed in said holder ring in said opening-providing means, between said axially opposite ends of said holder ring, and said outer surface of said side wall of said watch case lies radially surrounded by and radially spaced from said inner edge surface of said holder ring; and a radially-extending mount ring having a radially inner edge, resilient strip-like projection means based on said mount ring and extending axially therefrom adjacent said radially inner edge thereof in one direction;

claw means formed on said strip-like projection means so as to project radially inwardly beyond said radially inner edge of said mount ring;

said mount ring being disposed in axially confronting relation with an opposite said end of said holder ring with said resilient strip-like projection means telescopically received in said opening-providing means and disposed radially between said inner edge surface of said holder ring and said outer surface of said side wall of said case of said watch and said claw means caught in said radially outwardly-opening groove for retaining said watch mounted in said sheet of material.

3. The inlaid watch of claim 2, wherein:

said flange is continuous perimetrically of said watch case and substantially coplanar externally of said watch case with said rear wall of said watch case.

4. The inlaid watch of claim 2, wherein:

said holder ring is of U-shaped transverse cross-sectional shape and clamps said first and second surfaces of said sheet material perimetrically of said edge for clamping said holder ring in said opening.

* * * * *